United States Patent [19]

Redmore et al.

[11] 4,056,479

[45] Nov. 1, 1977

[54] MAGNESIUM CARBOXYLATE-SULFONATE COMPLEXES

[75] Inventors: Derek Redmore, Ballwin; Frederick T. Welge, Webster Groves, both of Mo.

[73] Assignee: Petrolite Corporation, St. Louis, Mo.

[21] Appl. No.: 686,707

[22] Filed: May 17, 1976

[51] Int. Cl.[2] ..... C10M 3/18; C10M 5/14; C10M 7/20; C10L 1/32

[52] U.S. Cl. ..... 252/18; 44/51; 44/DIG. 3; 252/25

[58] Field of Search ..... 252/18, 25, 33.2; 44/51, DIG. 3

[56] References Cited

U.S. PATENT DOCUMENTS

| | | | |
|---|---|---|---|
| 2,616,904 | 11/1952 | Asseff et al. | 252/33.2 |
| 2,895,913 | 7/1959 | Carlyle et al. | 252/33 |
| 3,150,089 | 9/1964 | Hunt | 252/33.2 |

*Primary Examiner*—Herbert Levine
*Assistant Examiner*—Irving Vaughn
*Attorney, Agent, or Firm*—Sidney B. Ring; Hyman F. Glass

[57] ABSTRACT

This invention relates to magnesium carboxylate and/or phenate-sulfonate complexes, processes for their preparation and uses therefor, particularly as fuel additives for vanadium-containing fuels.

2 Claims, No Drawings

MAGNESIUM CARBOXYLATE-SULFONATE COMPLEXES

In U.S. Pat. No. 3,150,089 there is described and claimed an invention illustrated by the following claims: Claim 23. As a new composition of matter, a magnesium alkoxide-carbonate complex having the following formula:

$$Mg(OCH_2CH_2OR)_{2-x}(O-\overset{\overset{\displaystyle O}{\|}}{C}-OCH_2CH_2OR)_x$$

wherein R is selected from the group consisting of (1) $C_1$ to $C_6$ alkyl group and (2) an organic radical having the formula $$-\overset{\overset{\displaystyle H}{|}}{\underset{\underset{\displaystyle H}{|}}{C}}-\overset{\overset{\displaystyle H}{|}}{\underset{\underset{\displaystyle H}{|}}{C}}-O-R'$$

wherein R′ is a $C_1$ to $C_4$ alkyl group, and wherein $x$ is a number varying from 0.5 to 1.5.

Claim 1. The process of preparing a stable dispersion of a basic, magnesium-containing, inorganic compound in a non-volatile carrier, said inorganic compound being present in the form of particles having a diameter not exceeding about 0.25 micron, said process comprising:

a. admixing a glycol ether solution of an oil-soluble magnesium alkoxide-carbonate complex, said complex having been prepared from a glycol ether having not more than 8 carbon atoms, an oil-soluble dispersing agent, liquid lubricating oil, and water in an amount in excess of the stoichiometric requirement for hydrolysis of said magnesium alkoxide-carbonate complex, b. hydrolyzing the magnesium alkoxide-carbonate complex to an oil-insoluble magnesium-containing inorganic compound, and then c. removing the volatile material, d. said process being characterized further in that the magnesium alkoxide-carbonate complex of step (a) is prepared by a process comprising:

1. reacting magnesium with a glycol ether having not more than 8 carbon atoms to a magnesium alkoxide.

2. reacting the magnesium alkoxide with from about 0.5 to about 1.5 moles of carbon dioxide per mole of said magnesium alkoxide to form a magnesium alkoxide-carbonate complex.

Although U.S. Pat. No. 3,150,089 describes compositions prepared from either carboxylic acids or sulfonic acids it does not describe complexes prepared from both carboxylic acids and sulfonic acids as a dual complex.

We have further discovered that Mg carboxylate and/or phenate-sulfonate complexes contain a substantially higher weight percentage of Mg than either the Mg carboxylate or the Mg sulfonate do individually, illustrating the synergistic effect of the Mg dual complex while giving less sediment that is achieved by either the carboxylate or sulfonate employed individually; thus illustrating the more efficient incorporation of magnesium by the dual complex. In addition, the dual complex is much less viscous than would be expected from a composition having such a high percentage of Mg.

In general, the present invention is carried out according to the process of U.S. Pat. No. 3,150,089 which is incorporated herein as part hereof.

The invention described in U.S. Pat. No. 3,150,089 may be summarized as follows:

"Broadly stated, the present invention relates to a magnesium alkoxide-carbonate complex having the following formula:

$$Mg(OCH_2CH_2OR)_{2-x}(O-\overset{\overset{\displaystyle O}{\|}}{C}-OCH_2CH_2OR)_x$$

where R is either a $C_1$ to $C_6$ alkyl group or an organic radical of the formula $$-\overset{\overset{\displaystyle H}{|}}{\underset{\underset{\displaystyle H}{|}}{C}}-\overset{\overset{\displaystyle H}{|}}{\underset{\underset{\displaystyle H}{|}}{C}}-O-R'$$

wherein R′ is a $C_1$ to $C_4$ alkyl group, and $x$ is from 0.5 to 1.5, preferably 0.75 to 1.0. This complex is particularly useful for preparing a stable dispersion of a basic, magnesium-containing, inorganic compound in a non-volatile carrier.

Another aspect of the present invention relates to a process for preparing the oil-soluble magnesium alkoxide-carbonate complex. Broadly stated, the process comprises:

A. Reacting magnesium with a glycol ether, which may be either a monoether of ethylene glycol or a monoether of diethylene glycol, to form a magnesium alkoxide.

B. Reacting the magnesium alkoxide with carbon dioxide to form an oil-soluble magnesium alkoxide-carbonate complex.

Still another aspect of the present invention relates to a process for preparing a stable dispersion of a basic, magnesium-containing inorganic compound in a non-volatile carrier, wherein the process comprises:

A. Admixing a glycol ether solution of an oil-soluble magnesium alkoxide-carbonate complex, an oil-soluble dispersing agent, a non-volatile carrier, and water in an amount which is a stoichiometric excess of that required to react with the magnesium alkoxide-carbonate complex, B. Hydrolyzing the magnesium alkoxide-carbonate complex to an oil-insoluble magnesium-containing inorganic compound, and then C. Removing the volatile material."

The present invention differs from U.S. Pat. No. 3,150,089 as follows:

1. A volatile rather than a non-volatile carrier is employed,

2. The oil-soluble dispersing agents are always a combination of both carboxylic and/or sulfonic acids, or 3. The sulfonic acid employed in the preferred embodiment — dodecylbenzene sulfonic acid — has a lower molecular weight (245) than the molecular weight of the sulfonic acids employed in U.S. Pat. No. 3,150,089 which have a minimum of at least 350, but preferably at least 400, 4. The present invention yields a product having a higher Mg content than that obtained in U.S. Pat. No. 3,150,089 yet is a relatively pourable state in view of its high Mg content, 5. In contrast to U.S. Pat. No. 3,150,089 which prefers fatty acids which are liquids at ambient temperatures down to 15° C, the present invention can employ high melting carboxylic acids such as stearic acid, etc. Thus, the combination of carboxylic acid and sulfonic acid makes high melting carboxylic acids suitable in the present invention.

The magnesium used in the process may be in form of bars, rods, turnings, or powder.

Suitable glycol ethers for use in the process include monoethers of ethylene glycol and monoethers of diethylene glycol. While any of these glycol ethers are suitable, generally we prefer not to use those containing above about 8 carbon atoms, since such glycol ethers have a high boiling point and require more heat for their removal. Preferred glycol ethers are the monoethyl ether of ethylene glycol and the monomethyl ether of ethylene glycol. These materials are available commercially under the trademarks Cellosolve and Methyl Cellosolve. The monomethyl ether of diethylene glycol is available commercially under the trademark "Carbitol."

The monoethers of ethylene glycol are also known as alkoxy alkanols, and more specifically as alkoxyethanols. These materials have the generic formula $$ROCH_2CH_2OH$$

where R is a $C_1$ to $C_6$ group. Similarly, the monoalkylether of diethylene glycol has the generic formula $HOCH_2CH_2OCH_2CH_2OR$, where R is a $C_1$ to $C_4$ alkyl group.

Suitable carboxylic acids which can be used include naphthenic acids, such as the substituted cyclopentane monocarboxylic acids, the substituted cyclohexane monocarboxylic acids and the substituted aliphatic polycyclic monocarboxylic acids containing at least 15 carbon atoms. Specific examples include cetyl cyclohexane carboxylic acids, dioctyl cyclopentane carboxylic acids, dilauryl decahydronaphthalene and stearyloctahydroindene carboxylic acids and the like and oil-soluble salts thereof. Suitable oil-soluble fatty acids are those containing at least about 8 carbon atoms. Specific examples include 2-ethyl hexanoic acid, pelargonic acid, oleic acid, palmitoleic acid, linoleic acid and riconoleic acid. Naturally occurring mixtures of predominantly unsaturated fatty acids, such as tall oil fatty acids, are particularly suitable. Examples of commercially available tall oil fatty acids include the "Crofatols," available from Crosby Chemical Company and the "Acintils," available from Arizona Chemical Company.

Suitable phenols include oil-soluble phenols such as mono- and poly- alkylated phenols such as octyl, nonyl, dodecyl phenol, tetradecyl phenol, or dialkylated phenols such as dibutyl, dihexyl, dinonyl, etc. Preferably, the total alkyl content is at least about 8 carbon atoms.

Volatile solvent as used herein refers to hydrocarbon solvents having a boiling point at normal atmospheric pressure of less than about 400° F. Some specific examples of such solvents are: petroleum naptha, hexane, heptane, octane, benzene, toluene, glycol ethers, monohydric alcohols containing from about 1 to about 6 carbon atoms and the like. Very desirable solvents are hexane, heptane, benzene, toluene, xylene, butanol and the monomethyl ether of ethylene glycol.

In contrast to U.S. Pat. No. 3,150,089 where "oil-soluble sulfonic acids" are defined as "those materials wherein the hydrocarbon portion of the molecule has a molecular weight in the range of about 300 to about 1000, preferably, this molecular weight is in the range of about 370 to about 700" the preferred sulfonates of the present invention have a hydrocarbon portion whose molecular weight is below 300. For example, the preferred sulfonate, dodecyl benzene sulfonate, has a hydrocarbon portion having a molecular weight of 245 which is below the minimum values stated in U.S. Pat. No. 3,150,089.

Examples of hydrocarbon groups of the sulfonic acids include alkyl, aryl, alkaryl, aralkyl, cycloalkyl, etc. groups, as illustrated by the following specific examples:

octyl
decyl
dodecyl
tetradecyl
hexadecyl
octadecyl
octyl phenyl
nonylphenyl
decylphenyl
dodecylphenyl
tetradecylphenyl
dipropylnaphthyl
dibutylnaphthyl
dioctylnaphthyl, etc.

Although we prefer a hyrocarbon moiety which has a molecular weight of less than about 300, the higher sulfonic acid disclosed in U.S. Pat. No. 3,150,089 may be employed but are not preferred.

The molar ratio of sulfonic acids to carboxylic acids and/or phenol can vary widely, such as from about 10:1 to 1:10, for example from about 5:1 to 1:5, but preferably from about 4:1 to 1:4.

The following illustrates the procedures for preparing the compositions of the present invention. The reaction may be summarized as follows:

$$CH_3OCH_2CH_2OH + Mg \rightarrow (CH_3OCH_2CH_2O)_2Mg + H_2 \qquad \text{Eq. 1}$$

The magnesium alkoxide is then reacted with carbon dioxide to form magnesium alkoxycarbonate.

$$(CH_2OCH_2CH_2O)_2Mg + CO_2 \longrightarrow CH_3OCH_2CH_2O\overset{\overset{\displaystyle O}{\|}}{C}\,O\,Mg\,OCH_2CH_2OCH_3 \qquad \text{Eq. 2}$$

EXAMPLE A

In a reaction equipped with a stirrer, thermometer and reflux condenser, methyl cellosolve is heated to 120° C and magnesium is added thereto while the temperature is maintained at 120° C until reaction commences. The reaction of Mg is exothermic so that additional heating is not required once the reaction starts. The remaining Mg is added portionwise so as to maintain temperature at 95°–115° C.

EXAMPLE B

After complete dissolution of Mg, $CO_2$ is passed into the Mg alkoxide solution. This step is carried out with cooling since initially this dissolution is slightly exotherm. In order to keep the viscosity of Mg alkoxide at a workable level, an excess of methyl cellosolve is employed. An excess of carbon dioxide is employed to facilitate complete reaction.

Eq. 3

$$CH_3OCH_2CH_2O\overset{O}{\overset{\|}{C}}O\,Mg\,O\,CH_2CH_2OCH_3 + \text{naphthenic acid} + \text{dodecylbenzene sulfonic acid} + H_2O \longrightarrow Mg\ \text{product}$$

EXAMPLE C

The magnesium alkoxycarbonate is added to naphthenic acid and dodecylbenzene sulfonic acid in the presence of benzene and water over a period of 30 minutes. The resulting mixture is heated at reflux, e.g., 76° C. for 1 hr., followed by removal of volatiles (benzene and water) by distillation. Kerosene is added and distillation is contained to remove cellosolves. A small amount of solids are removed by centrifugation or filtration. Excess kerosene is removed to yield an oil-soluble magnesium product having a 13–14% Mg content and containing from 20–50% kerosene or other solvent. The exact amount of solvent in the product will determine the viscosity.

The following examples are presented to illustrate the effect of variation in the ratio and types of acids employed.

EXAMPLE 1

Preparation with magnesium/acids ratio of 9:1

To a stirred solution of oleic acid (4.7g; 0.017 mole) and dodecylbenzene sulfonic acid (16.2g; 0.050 mole) in benzene (300 ml), isopropanol (10 ml) and water (40 ml) was added a solution of magnesium methoxyethoxide carbonate in methylcellosolve (311g containing 0.6 equiv of magnesium) during 30 min. After heating at reflux for 2 hrs. solvents were removed by distillation. After 300 ml of distillate had been collected kerosene (50 ml) was added and distillation was continued until 650 ml of distillate was collected. After cooling the reaction product was centrifuged to remove approx. 3 ml of sediment and yield a clear product 110.8g very fluid with magnesium content of 13.3%.

EXAMPLE 2

Preparation with magnesium/acids ratio 8.3:1

To a stirred solution of napthenic acid (15g; 0.033 mole) and dodecylbenzenesulfonic acid (10.8g; 0.033 mole) in a mixture of xylene (315g), isopropanol (10 ml), mineral oil (10g) and water (50 ml) was added magnesium methoxyethoxide carbonate (248g containing 0.55 mole magnesium) during 30 min. The mixture was heated at reflux for 1½ hrs. (94°) and solvents removed by distillation (542g). After cooling the product was centrifuged yielding 3 ml sediment and a clear fluid product (95g) containing 13.9% magnesium.

EXAMPLE 3

Preparation with magnesium/acids ratio 9:1

To a stirred solution of naphthenic acid (15g; 0.033 mole) and dodecylbenzenesulfonic acid (10.8g; 0.033 mole) in a mixture of xylene (315g), isopropanol (10 ml), mineral oil (10g) and water (54 ml) was added a solution of magnesium methoxyethoxide carbonate in methyl cellosolve (270g containing 0.6 equiv. of magnesium) during 30 min. After heating at reflux for 1 hour the solvents were removed by distillation. After cooling and centrifugation to remove sediment (4 ml) a clear fluid product (98g) was obtained with magnesium content 14.6%.

EXAMPLE 4

Preparation with magnesium/acids ratio 10:1

To a stirred solution of naphthenic acid (15g; 0.033 mole) and dodecylbenzene sulfonic acid (10.8g; 0.033 mole) in a mixture of xylene (315g), isopropanol (10 ml), mineral oil (10g) and water (59g) was added during 35 min. a solution of magnesium methoxyethoxide carbonate in methylcellosolve (298g containing 0.66 equiv. of magnesium). After heating at reflux for 1 hr. volatiles were removed by distillation (up to 160°) yielding a product which was clarified by centrifugation (5 ml sediment). The product (110g) was a bright fluid with magnesium content of 14.5%.

EXAMPLE 5

Preparation with magnesium/acids ratio of 4.7:1

To a solution of Crofatol P (40g; 0.13 mole) and Marco H-50 (a petroleum sulfonic acid) (45g; 0.044 mole) in a mixture of xylene (150g) and water (75g) was added during 30 min. with stirring magnesium methoxyethoxide carbonate in methyl cellosolve (370g containing 0.82 equiv. of magnesium). After heating at reflux for 2 hrs. the volatiles were remoed by distillation. After cooling and centrifugation a fluid bright produt with magnesium content of 13.2% was obtained.

The following table summarizes results obtained using mixtures of dodecylbenzenesulfonic acid (DDBSA) with other acids.

| Ex. | Method of Ex. | Acid | Mole ratio of Acid/DDBSA | Magnesium Content | Sediment |
|---|---|---|---|---|---|
| 6 | 1 | Lauric acid | 1:3 | 12.5% | 0.1 ml |
| 7 | 1 | Stearic acid | 1:3 | 13.2% | 0.3 ml |
| 8 | 1 | Docosanoic acid | 1:3 | 13.5% | 0.7 ml |
| 9 | 5 | Marco H-50 | 1:1 | 12.1% | 8 ml |
| 10 | 3 | Sunaptic B | 1:1 | 14.6% | 4 ml |
| 11 | 1 | Oleic acid | 1:3 | 13.3% | 3 ml |
| 12 | 2 | Crofatol P | 1:1 | 12.6% | 1.5 ml |
| 13 | 2 | Hercules Pamak | 1:1 | 13.3% | 2.3 ml |
| 14 | 1 | Nonyl phenol | 2:3 | 12.9% | 5 ml |
| 15 | 1 | Lauric acid/ Sunaptic B | 1:3:6 | 14.4% | 3 ml |
| 16 | 1 | Nonyl phenol/ Stearic acid | 1:1:3 | 14.1% | 1 ml |

Marco H-50 is a petroleum sulfonic acid (Marathon Marco Co)
Sunaptic B is a naphthenic acid (Sun Oil)
Crafatol P is a Tall oil fatty acid (Crosby Chemical)

The following table shows improved incorporation of magnesium using combinations of napthenic acid (Sunaptic B) and dodecylbenzenesulfonic acid.

This table summarizes reactions carried out according to Example 1.

| | | | | | | | | |
|---|---|---|---|---|---|---|---|---|
| % Sunaptic acid | 100 | 75 | 60 | 50 | 40 | 25 | 20 | 0 |
| % Dodecylbenzene sulfonic acid | 0 | 25 | 40 | 50 | 60 | 75 | 80 | 100 |
| Sediment (ml) | 24 | 10 | 11 | 5 | 4 | 3.5 | 1.5 | 80 |
| Magnesium content % | 13.5 | 14.3 | 14.0 | 14.2 | 14.0 | 14.4 | 13.3 | — |

It can be seen that combinations are particularly effective in giving low amounts of sediment while achieving high magnesium content.

We claim:

1. A process of preparing a stable dispersion of a basic, magnesium-containing, inorganic compound having a magnesium content of about 12.5% to about 14.6% which comprises (a) admixing (1) a glycol ether solution of an oil-soluble magnesium alkoxide-carbonate complex, said complex having been prepared from a glycol ether having not more than 8 carbon atoms, (2) an oil-soluble sulfonate, (3) a carboxylate- and/or phenate dispersing agent, (4) a volatile carrier and (5) water in excess of the stoichometric requirement for hydrolysis of said magnesium-alkoxide-carbonate complex, b. hydrolyzing the magnesium-alkoxide-carbonate complex to an oil-soluble magnesium-containing inorganic compound, at reflux temperature for a period of about 1 to 2 hours, and then c. removing the volatile carrier to the desired viscosity, d. said process being characterized further in that the magnesium-alkoxide-carbonate complex of step (a) is prepared by a process comprising 1. reacting magnesium with a glycol ether having not more than 8 carbon atoms to form the magnesium alkoxide; and 2. reacting the magnesium alkoxide with from 0.5 to about 1.5 mols of carbon dioxide per mole of said magnesium alkoxide to form a magnesium-alkoxide-carbonate complex.

2. The product obtained by the process of claim 1.

* * * * *